US007234963B1

(12) United States Patent
Huang

(10) Patent No.: US 7,234,963 B1
(45) Date of Patent: Jun. 26, 2007

(54) USB CONNECTOR WITH ORIENTATION ADJUSTMENT

(76) Inventor: Kui-Hsien Huang, 10F-1, No. 452, Sec. 5, Cheng Kung Rd., Nei Ha District, Taipei City (TW)

( * ) Notice: Subject to any disclaimer, the term of this patent is extended or adjusted under 35 U.S.C. 154(b) by 0 days.

(21) Appl. No.: 11/557,504

(22) Filed: Nov. 8, 2006

(51) Int. Cl.
*H01R 13/56* (2006.01)

(52) U.S. Cl. ..... 439/446; 439/731

(58) Field of Classification Search ..... 439/11, 439/13, 446, 731, 906
See application file for complete search history.

(56) References Cited

U.S. PATENT DOCUMENTS

| | | | | |
|---|---|---|---|---|
| 4,959,021 | A * | 9/1990 | Byrne | 439/310 |
| 5,092,793 | A * | 3/1992 | Stephan | 439/446 |
| 5,499,932 | A * | 3/1996 | Tanaka et al. | 439/446 |
| 6,220,889 | B1 * | 4/2001 | Ely et al. | 439/446 |
| 6,406,314 | B1 * | 6/2002 | Byrne | 439/215 |
| 6,716,058 | B2 * | 4/2004 | Youn | 439/535 |
| 7,186,133 | B1 * | 3/2007 | Szczesny | 439/446 |

* cited by examiner

*Primary Examiner*—Khiem Nguyen
(74) *Attorney, Agent, or Firm*—Leong C. Lei

(57) ABSTRACT

A USB connector with orientation adjustment is disclosed. The USB connector comprises a top cover, a connector seat with a cable slot, a cable rotating seat, cable and a bottom cover. The top cover is engageable with the bottom cover enclosing the connector seat and the cable rotating seat; the connector seat is a structure for connecting the branched wire of the cable, and the cable slot to the cable; the cable rotating seat is a circular seat plate having a pivot slot at the center of the rotating seat, and the bottom section of the circular seat plate is provided with a plurality of positioning holes and the lateral side of the circular seat plate is provided with through holes; the end of cable passes through the lateral through hole of the pivot slot of the cable rotating seat, and the branched cable is connected to the cable slot of the connector seat; the bottom cover is engaged with the top cover by means of peg and the covers encloses the connector seat and the cable rotating seat, and an engaging body mounted below the bottom cover is engaged with an engaging slot of the connector seat such that the connector seat exposes only a fixed length, and the rear section of the bottom cover is a protruded circular engaging plate which is directly pivotally mounted to the pivot slot of the cable rotating seat and is engaged at the positioning hole of the rotating seat by the positioning points.

1 Claim, 5 Drawing Sheets

USB CONNECTOR WITH ORIENTATION ADJUSTMENT

BACKGROUND OF THE INVENTION (a) Technical Field of the Invention

The present invention relates to USB connector, and in particular, a USB connector with direction adjustment mechanism, allowing a connector cable to turn from 0 degree to 180 degrees direction.

(b) Description of the Prior Art

Computers and digital devices are generally provided with USB interface connection port for external connection of memory. Conventional USB connector is shown in FIG. 1 which is an insertion connector A1 having an exposed USB insertion end A2 which can be inserted to the USB interface connection port. The rear end is a simple cable structure with no direction adjustment mechanism. Thus, the conventional USB connector is inherited with drawbacks as follows:

- the connectors of the digital devices and computers together with the cables are entangled with each other as a result of the fixed direction mechanism connecting the cable to the USB connector;
- the cable after distorted or twisted shall not be able to restore to the original shape and it may causes the wire within the cable to break; and conventional USB connector is easily dislocated due to constantly pulling and twisting of cable.

As a result of the drawbacks mentioned above, it is an object of the present invention to provide a USB connector with orientation adjustment to overcome or mitigate the shortcomings.

SUMMARY OF THE INVENTION

The primary purpose of the present invention is to provide a USB connector with orientation adjustment mechanism comprising a top cover, a connector seat with a cable slot, a cable rotating seat, cable and a bottom cover, characterized in that the top cover is engageable with the bottom cover enclosing the connector seat and the cable rotating seat; the connector seat is a structure for connecting the branched wire of the cable, and the cable slot to the cable; the cable rotating seat is a circular seat plate having a pivot slot at the center of the rotating seat, and the bottom section of the circular seat plate is provided with a plurality of positioning holes and the lateral side of the circular seat plate is provided with through holes; the end of cable passes through the lateral through hole of the pivot slot of the cable rotating seat, and the branched cable is connected to the cable slot of the connector seat; the bottom cover is engaged with the top cover by means of a peg and the covers encloses the connector seat and the cable rotating seat, and an engaging body mounted below the bottom cover is engaged with an engaging slot of the connector seat such that the connector seat exposes only a fixed length, and the rear section of the bottom cover is a protruded circular engaging plate which is directly pivotally mounted to the pivot slot of the cable rotating seat and is engaged at the positioning hole of the rotating seat by the positioning points.

Yet another object of the present invention is to provide a USB connector with orientation adjustment, wherein the mounting of the USB connector is secured.

A further object of the present invention is to provide a USB connector with orientation adjustment, wherein the direction of the USB can be changed in accordance with the arrangement of the cable such that the USB connector is not restricted by the direction of cable.

Yet a further object of the present invention is to provide a USB connector with orientation adjustment, wherein the cable twisting at the USB connector is prevented and therefore the transmission of signal is stable.

Still a further object of the present invention is to provide a USB connector with orientation adjustment, wherein the orientation of the cable and the corner is maintained at a specific position.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and feature of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
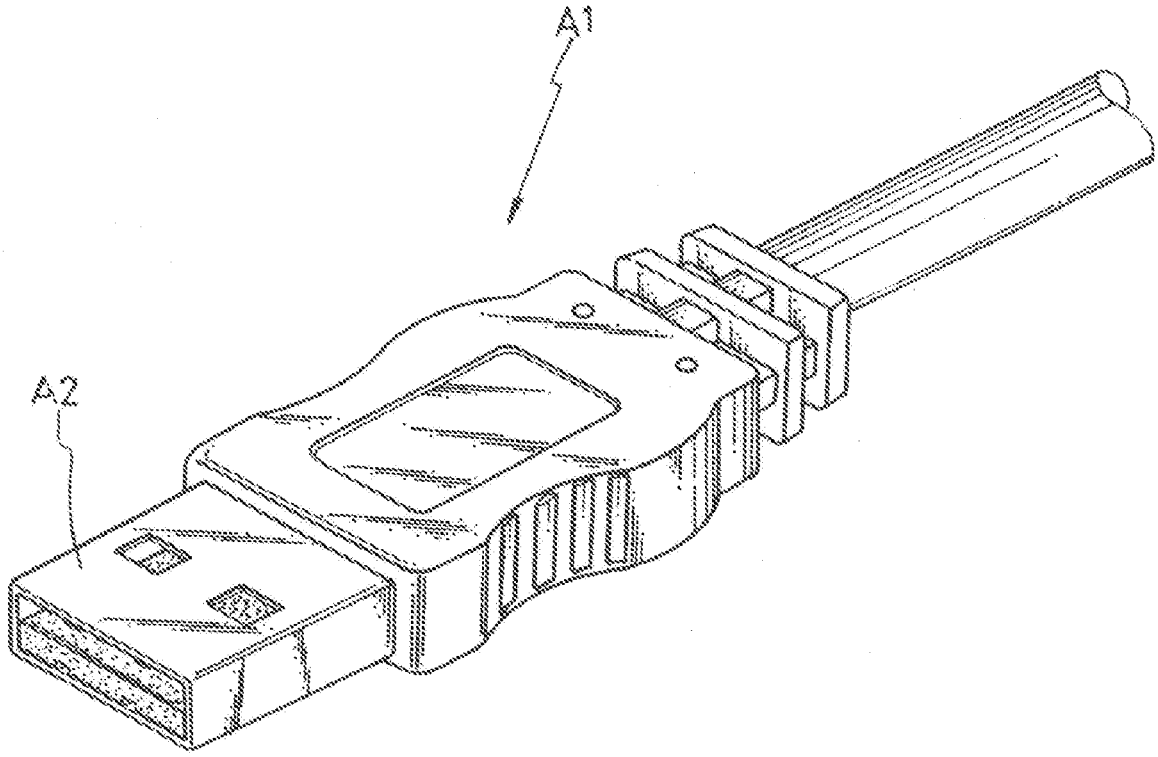
PRIOR ART FIG. 1
FIG. 1 is a perspective view of a conventional USB connector.
Figure 2:
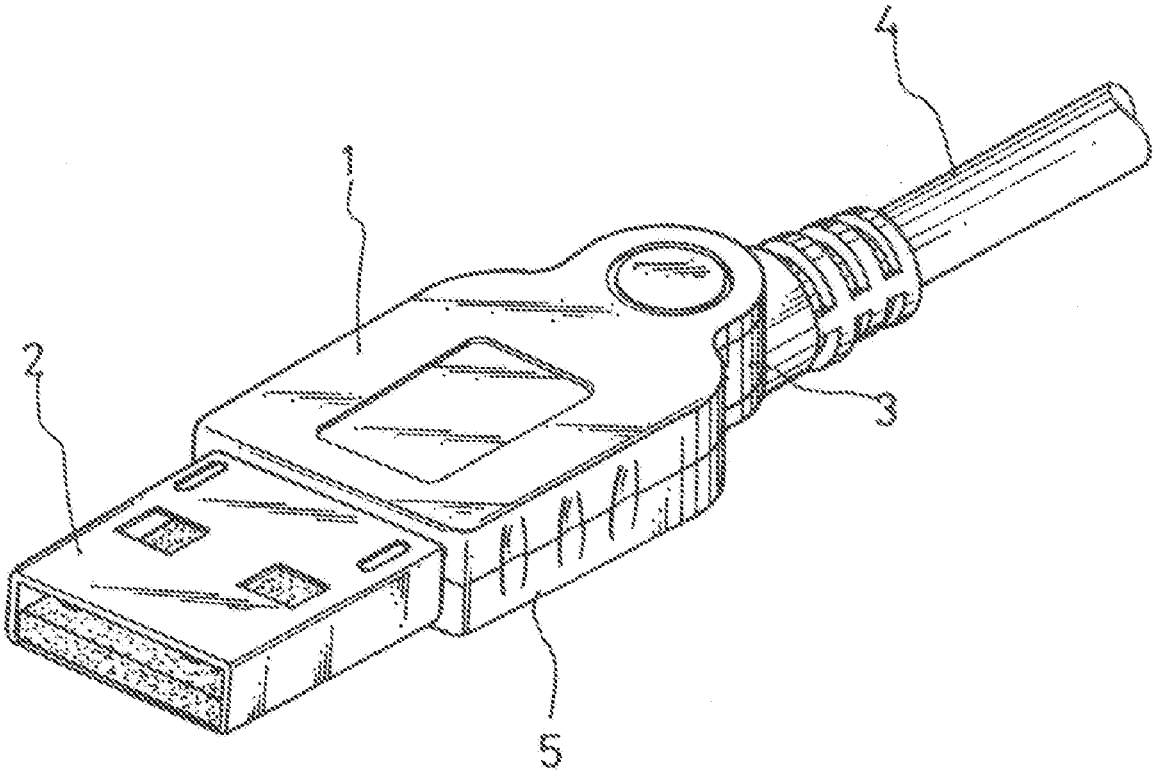
FIG. 2 is a schematic perspective view of the USB connector in accordance with the present invention.
Figure 3:
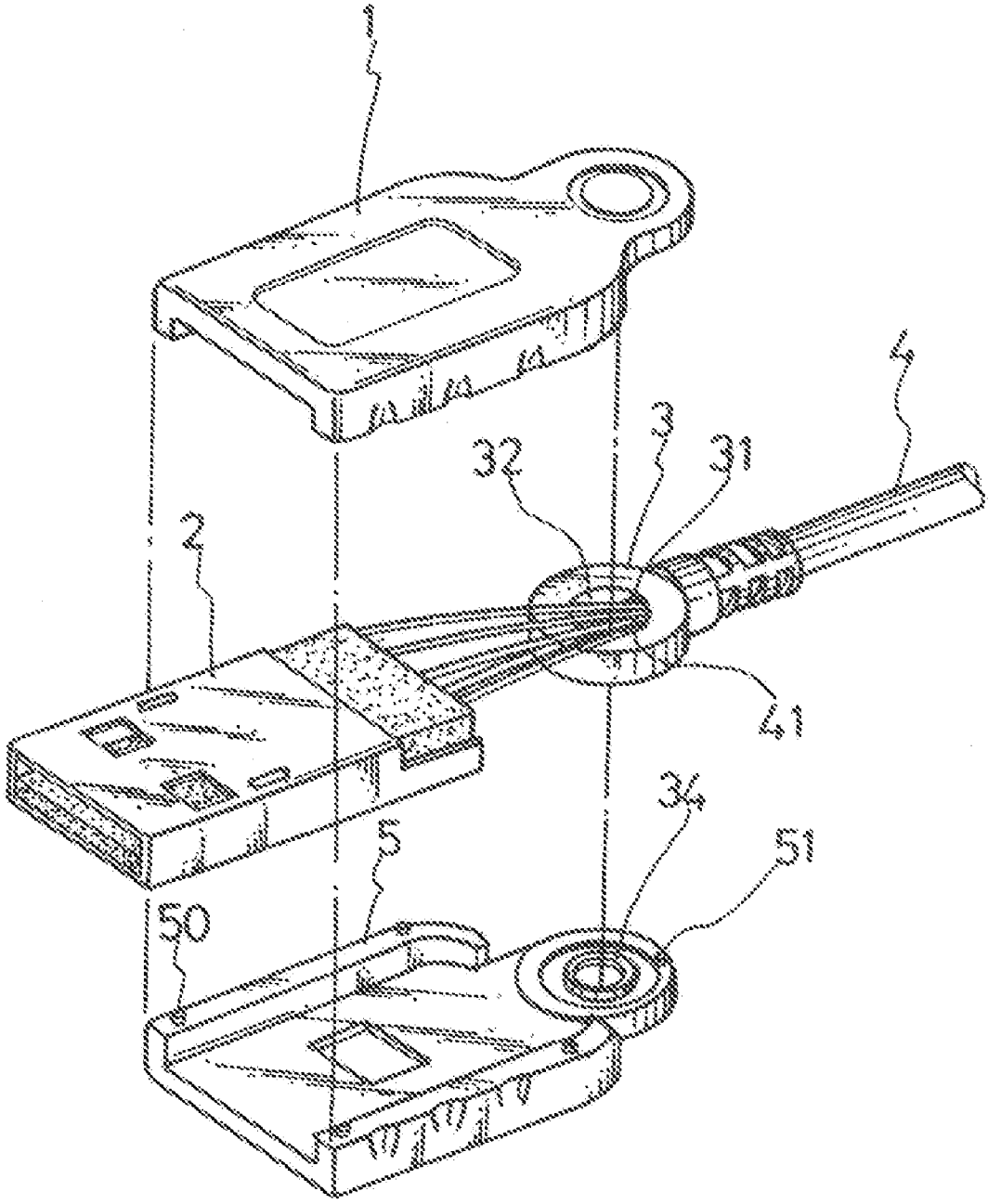
FIG. 3 is a perspective exploded view of the USB connector in accordance with the present invention.
Figure 4:
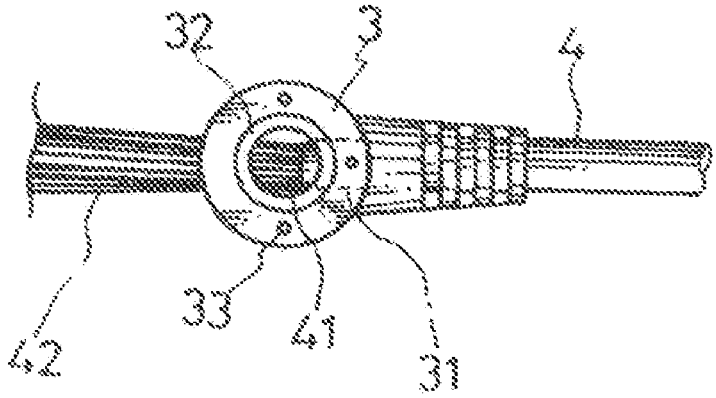
FIG. 4 is a schematic bottom view of the cable rotating seat of cable of the present invention.

As shown in FIGS. 3 and 4, the cable rotating seat 3 is a circular seat plate having a pivot slot 32 at the center of the rotating seat 3, and the bottom of the rotating seat 3 is a plurality of positioning holes 33 for the engaging of the positioning points 51 of the bottom cover 5. After the rotating adjustment of the cable, positioning could be made and the connector shall be in that specific orientation, as shown in FIG. 6.

Figure 5:
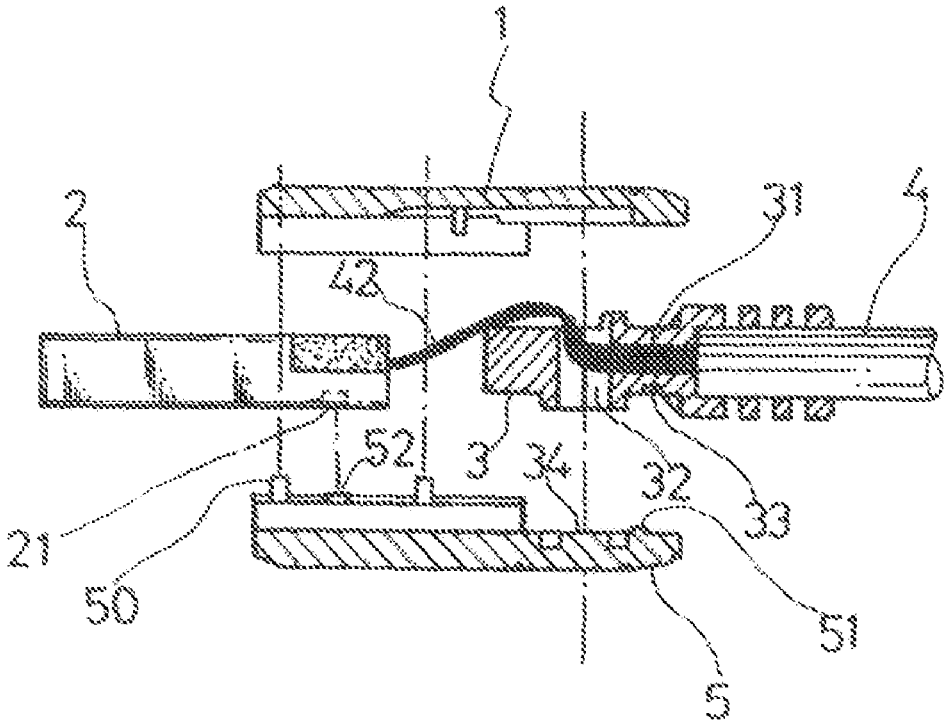
FIG. 5 is a schematic exploded view of the rotating seat of cable of the present invention.

As shown in FIGS. 3, and 5, the top and bottom cover 1, 5 are engaged with each other by means of a peg 50 to enclose the connector seat 2 and the cable rotating seat 3, and the rotating seat 3 is pivotally enclosed within the top and the bottom cover 1,5, and the pivot slot 32 is the rotating center for the connector 2 to rotate 180 degree. As shown in FIG. 6, the connector 2 enclosed by the top and the bottom cover 1, 5 has an engaging slot 21 for the securing of the engaging body 52 provided at the bottom cover 5 such that the engaging slot 21 exposes a fixed length to form the connecting seat 2 of the connector, and the rear of the rotating seat 3 is directly pivotally connected to the circular engaging plate 34 at the rear section of the bottom cover 5, and the positioning point 51 corresponds with the positioning hole 33 such that the adjustment of the orientation of the cable is attained.

Figure 6:
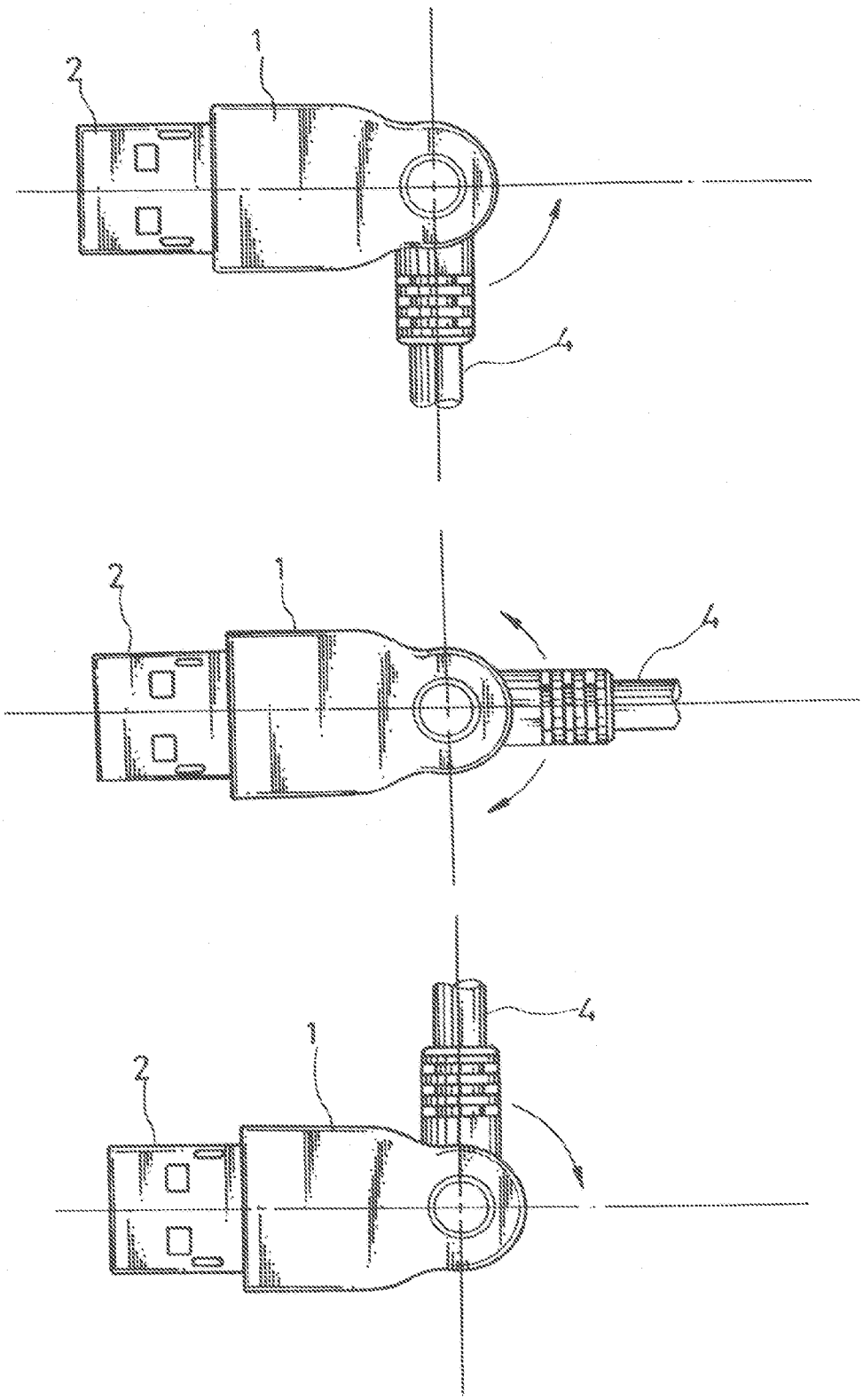
FIG. 6 is a schematic view showing the application of the USB connector in accordance with the present invention.

FIG. 6 indicates the operation of the USB connector in accordance with the present invention. In the figure, the orientations of cable 4 are positioned vertically downward to the rear of the USB connector, in axial position with the USB connector and positioned vertically upward to the rear of the USB connector.

As shown in FIG. 6, the cable 4 is rotating about the rotating cable seat 3 and the positioning of the cable 4 is secured by the plurality of positioning holes 33 and the positioning points 51 provided at the bottom section of the pivot slot 32 as described.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A USB connector with orientation adjustment mechanism comprising a top cover, a connector seat with a cable slot, a cable rotating seat, cable and a bottom cover, characterized in that the top cover is engageable with the bottom cover enclosing the connector seat and the cable rotating seat;

the connector seat is a structure for connecting the branched wire of the cable, and the cable slot to the cable;

the cable rotating seat is a circular seat plate having a pivot slot at the center of the rotating seat, and the bottom section of the circular seat plate is provided with a plurality of positioning holes and the lateral side of the circular seat plate is provided with through holes;

the end of cable passes through the lateral through hole of the pivot slot of the cable rotating seat, and the branched cable is connected to the cable slot of the connector seat;

the bottom cover is engaged with the top cover by means of peg and the covers encloses the connector seat and the cable rotating seat, and an engaging body mounted below the bottom cover is engaged with an engaging slot of the connector seat such that the connector seat exposes only a fixed length, and the rear section of the bottom cover is a protruded circular engaging plate which is directly pivotally mounted to the pivot slot of the cable rotating seat and is engaged at the positioning hole of the rotating seat by the positioning points.

* * * * *